US007916119B2

(12) United States Patent
Namki

(10) Patent No.: US 7,916,119 B2
(45) Date of Patent: Mar. 29, 2011

(54) INVERTER FOR SETTING INITIAL DRIVING FREQUENCY FOR A LIQUID CRYSTAL DISPLAY AND DRIVING METHOD THEREOF

(75) Inventor: La Namki, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 759 days.

(21) Appl. No.: 11/984,110

(22) Filed: Nov. 13, 2007

(65) Prior Publication Data

US 2008/0122781 A1 May 29, 2008

(30) Foreign Application Priority Data

Nov. 13, 2006 (KR) ..... 10-2006-0111602

(51) Int. Cl.
*G09G 3/36* (2006.01)

(52) U.S. Cl. ..... 345/102

(58) Field of Classification Search ..... 345/102; 349/61–70; 362/561
See application file for complete search history.

(56) References Cited

U.S. PATENT DOCUMENTS 6,531,835 B2 * 3/2003 Chen et al. ..... 315/307
7,348,960 B2 * 3/2008 Huang et al. ..... 345/102
2007/0040517 A1 * 2/2007 Yu ..... 315/291

* cited by examiner

*Primary Examiner* — Chanh Nguyen
*Assistant Examiner* — Ram A Mistry
(74) *Attorney, Agent, or Firm* — McKenna Long & Aldridge LLP

(57) ABSTRACT

An inverter for a liquid crystal display and its driving method are disclosed. The inverter includes: a DC/AC converting unit that converts DC power supplied from a voltage source into AC power; a transformer that converts the AC power supplied from the DC/AC converting unit into a high voltage AC; and a frequency controller that determines the frequency of an output of the DC/AC converting unit such the output of the DC/AC converting unit has an initial driving frequency during an initial driving time that beings upon initiating driving of the liquid crystal panel and such that that the output of the DC/AC converting unit has a normal driving frequency larger than the initial driving frequency after the initial driving time.

11 Claims, 5 Drawing Sheets

(a)

(b)

INVERTER FOR SETTING INITIAL DRIVING FREQUENCY FOR A LIQUID CRYSTAL DISPLAY AND DRIVING METHOD THEREOF

This application claims the benefit of Korean Patent Application No. 10-2006-0111602, filed on Nov. 13, 2006, which is hereby incorporated by reference for all purposes as if fully set forth herein.

BACKGROUND OF THE INVENTION

1. Field of the Invention

The present invention relates to liquid crystal displays and more particularly to an inverter for use in a liquid crystal display.

2. Discussion of the Related Art

A liquid crystal display device (LCD) is a display device in which a liquid crystal layer with an anisotropic dielectric constant is formed between upper and lower substrates, transparent insulation substrates. By controlling an electric field applied to the liquid crystal layer, the molecular arrangement of the liquid crystal layer material is varied to control an amount of light transmitted through the liquid crystal layer and the upper substrate display surface to display a desired image.

The LCD includes a liquid crystal module (LCM), a driving circuit unit that drives the LCM, and an outer case that covers and protects the LCM.

The LCM includes a liquid crystal panel in which liquid crystal cells are arranged in a matrix form between the two transparent insulation substrates, a backlight assembly that provide light to the liquid crystal panel, and a cover that protects the liquid crystal panel and the backlight assembly.

The backlight assembly is provided to emit light and uses cold cathode fluorescent lamps (CCFLs), or exterior electrode fluorescent lamps (EEFLs) or the like as a light source.

Backlight assembly that use CCFLs or the EEFLs typically use an inverter that converting DC power into AC power for driving the lamps.

The inverter includes a transformer that supplies AC power to an output terminal, and a balancer capacitor that is connected between a secondary side of the transformer the lamps and that limits and balances current supplied to each lamp and that matches the impedance between the output terminal of the inverter to the impedance of lamps.

However, when the backlight assembly is driven by the inverter of the related art, a partial dimness appears during an initial driving due to an unbalance between an impedance component by equivalent capacitors of the lamps and that by the balancer capacitors, resulting in degradation of display quality.

SUMMARY OF THE INVENTION

Accordingly, the present invention is directed to an inverter for a liquid crystal display and a driving method thereof that substantially obviates one or more of the problems due to limitations and disadvantages of the related art.

An advantage of the present invention is to provide an inverter for a liquid crystal display (LCD) capable of minimizing an impedance deviation between an output terminal and a lamp, a load of the output terminal, by properly lowering a driving frequency and applying the lowered frequency during an initial driving time, and a method for driving the same.

Another advantage of the present invention is to provide an inverter for an LCD capable of reducing a partial dimness phenomenon caused by an impedance deviation and obtaining display quality, and a method for driving the same.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an inverter for an LCD includes: a DC/AC converting unit that converts DC power supplied from a voltage source into AC power; a transformer that converts the AC power supplied from the DC/AC converting unit into a high voltage AC; and a frequency controller that determines the frequency of an output of the DC/AC converting unit such the output of the DC/AC converting unit has an initial driving frequency during an initial driving time that beings upon initiating driving of the liquid crystal panel and such that that the output of the DC/AC converting unit has a normal driving frequency larger than the initial driving frequency after the initial driving time.

In another aspect, a method for driving an inverter for an LCD includes: converting DC power supplied to an input terminal into AC power; converting the AC power into a high voltage AC and outputting the same; controlling converting DC power supplied to the input terminal into AC power such that the AC power has an initial driving frequency during an initial driving; and controlling converting DC power supplied to the input terminal into AC power such that the AC power has a normal driving frequency larger than the initial driving frequency during a normal driving that follows the initial driving.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, an example of which is illustrated in the accompanying drawings.

Figure 1:
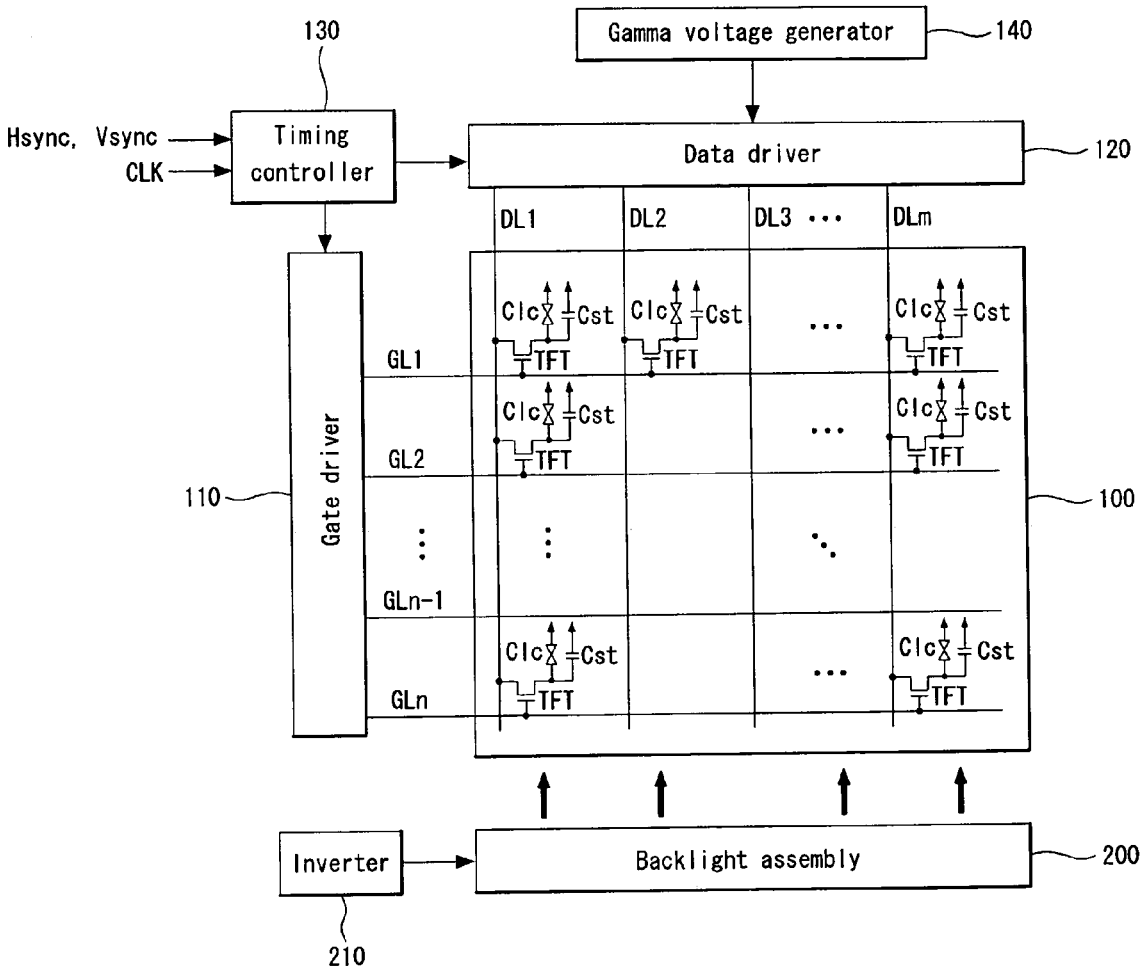
FIG. 1 is a view schematically illustrating the construction of a liquid crystal display (LCD) employing an inverter according to an embodiment of the present invention.
Figure 2:
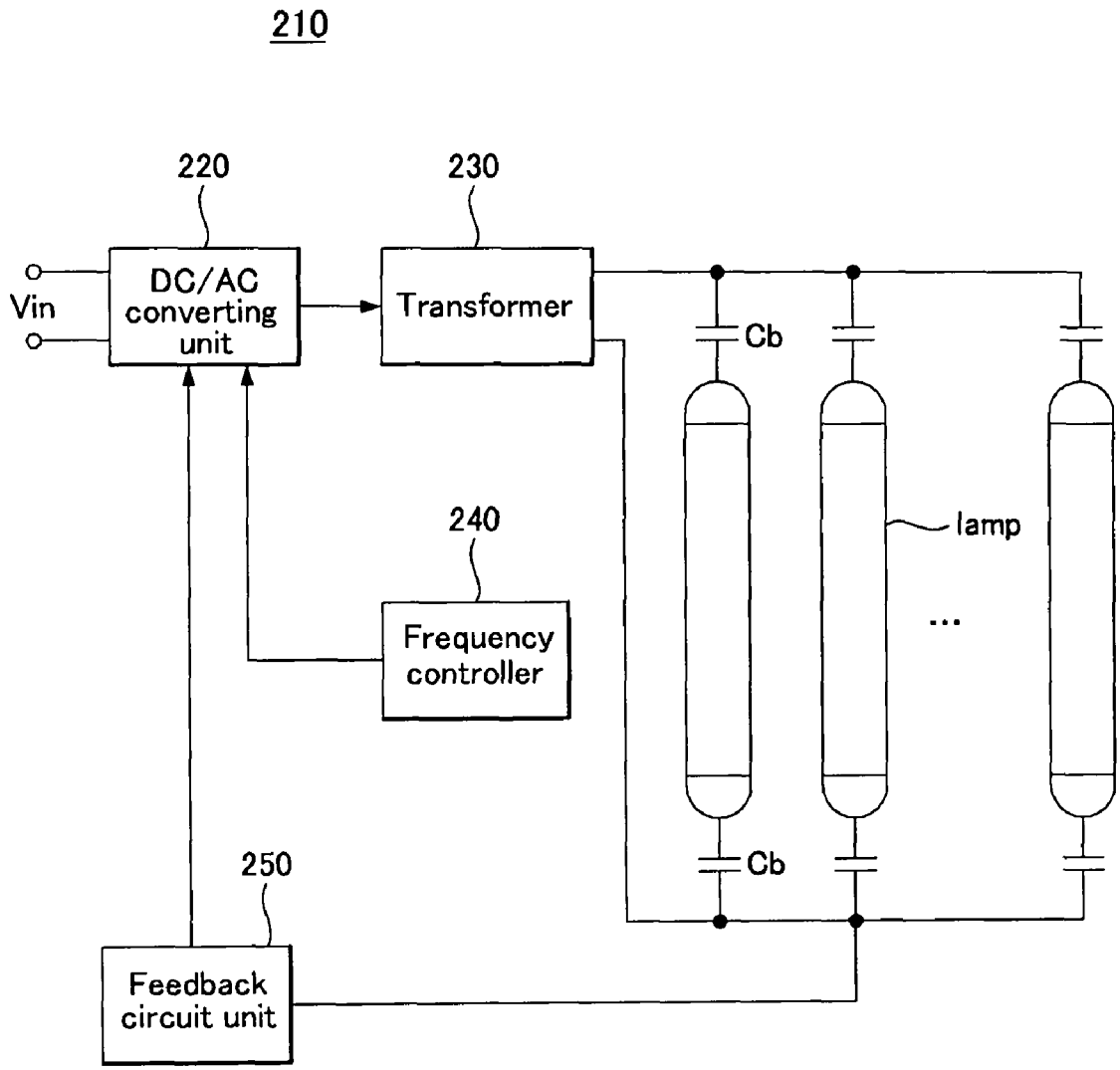
FIG. 2 is a view showing details of the construction of the inverter in FIG. 1.

As illustrated in FIGS. 1 and 2, an inverter for a liquid crystal display (LCD) according to an embodiment of the present invention includes: a DC/AC converting unit 220 that converts DC power supplied from a voltage source into AC power; a transformer 230 that converts the AC power supplied from the DC/AC converting unit 220 into a high voltage AC;

and a frequency controller 240 that controls an output of the DC/AC converting unit 220 have an initial driving frequency when a lamp for providing a light source to a liquid crystal panel 100 is initially driven, and that further controls the output of the DC/AC converting unit 220 to have a normal driving frequency larger than the initial driving frequency when the lamp is normally driven following the initial driving.

The frequency controller 240 may be combined with or connected to an input terminal of the DC/AC converting unit 220 and may determine the frequency of an AC voltage output from the DC/AC converting unit 220.

The frequency controller may include a resistor and a capacitor for determining an initial driving time.

Figure 3A:
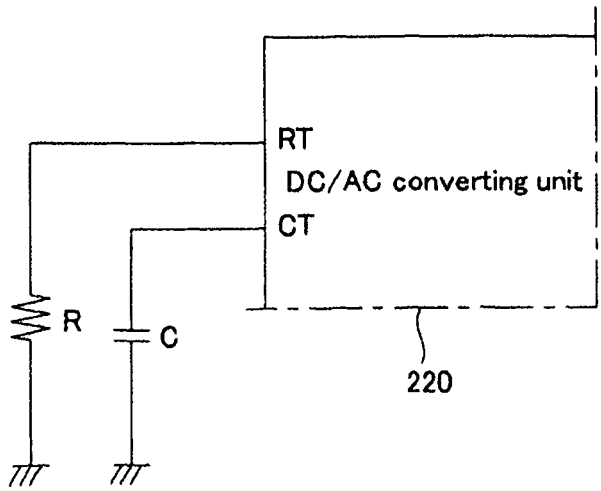
FIGS. 3A and 3B are views showing details of a frequency controller shown in FIG. 2.
Figure 3B:
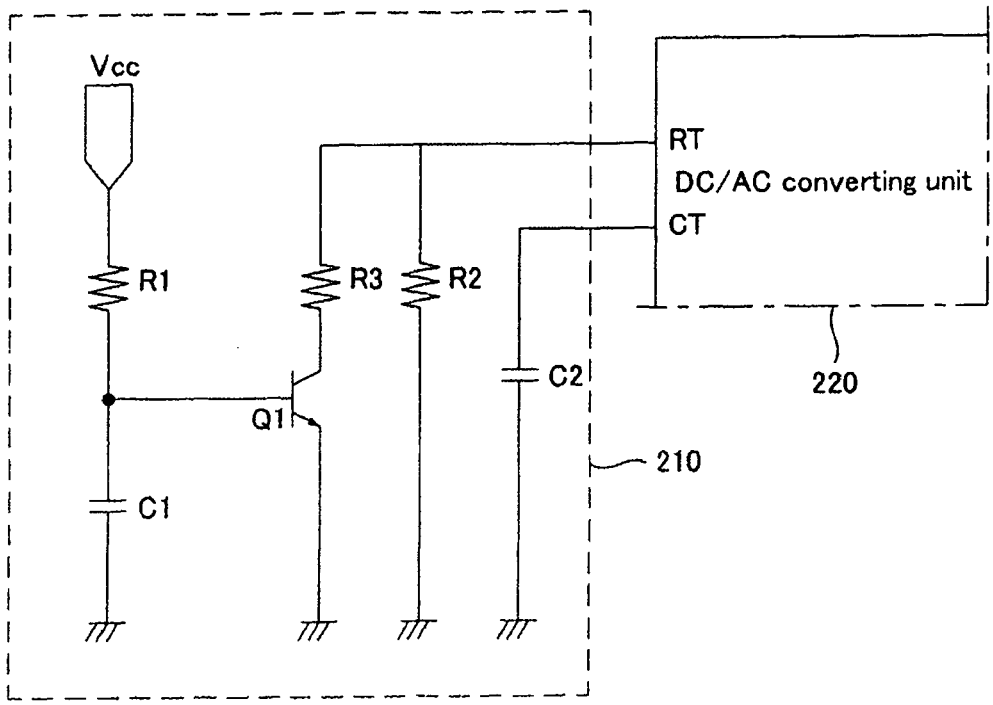

As shown in FIG. 3B, the frequency controller 240 may include: a first resistor having one end connected to a power source voltage Vcc; a first capacitor connected between the other end of the first resistor and a ground potential source; a transistor including a base connected to a node between the first resistor and the first capacitor, and an emitter connected to a ground potential; a second resistor connected between a collector of the transistor and a first input terminal of the DC/AC converting unit; and a third resistor having one end connected to the first input terminal of the DC/AC converting unit 220 and the other end connected to the ground potential so as to be connected in parallel with the second resistor.

The inverter may further include: a second capacitor connected between a second input terminal of the DC/AC converting unit 220 and the ground potential, and having a parallel relationship with the third resistor.

Upon application of the initial driving voltage, the transistor of the frequency controller 240 may be maintained in a turned-off state for a time period determined by the first resistor and the first capacitor. While transistor is in the turned-off state, the initial driving frequency is then determined by the third resistor R2 and the second capacitor C2 which are connected in parallel during the initial driving time.

After the initial driving time, transistor is turned for normal driving and the normal driving frequency may be determined by the parallel combination of the second resistor, the third resistor, and the second capacitor formed by the turning on of the transistor.

The transistor Q1 may be a bipolar junction transistor (BJT).

The inverter 210 may further include a feedback circuit unit 250 that detects a feedback signal from the lamp connected to a secondary side of the transformer and supplies the feedback signal to the DC/AC converting unit.

The feedback signal may be a tube current supplied to the lamp may alternatively be a signal representing a voltage applied across the lamp.

A method for driving an inverter for an LCD includes: converting DC power supplied to an input terminal into AC power; converting the AC power into a high voltage AC and outputting the same; controlling the conversion of DC power to AC power such that the AC has an initial driving frequency during an initial driving time; and controlling the conversion of DC power to AC power such that the AC has a normal driving frequency larger than the initial driving frequency during a normal driving time that follows the initial driving time.

The controlling such that the AC has an initial driving frequency during the initial driving and the controlling such that the AC has a normal driving frequency larger than the initial driving frequency during the normal driving that follows the initial driving may be performed by a frequency controller that includes a first resistor having one end connected with a power source voltage, a first capacitor formed between the other end of the first resistor and a ground potential source, a transistor including a base connected with a node between the first resistor and the first capacitor, and an emitter connected with a ground potential source, a second resistor connected between a collector of the transistor and a first input terminal of the DC/AC converting unit, and a third resistor having one end connected with the first input terminal of the DC/AC converting unit and the other end connected with a ground potential source, so as to be connected in parallel with the second resistor.

In controlling such that the AC has an initial driving frequency during the initial driving, the transistor may be maintained in a turned-off state during the initial driving time having a duration determined by the first resistor and the first capacitor, and the initial driving frequency may be determined by the third resistor and the second capacitor during the initial driving time.

In controlling such that the AC has a normal driving frequency larger than the initial driving frequency during the normal driving that follows the initial driving, the transistor may be turned on during the normal driving following the initial driving time, and the normal driving frequency may be determined by the second resistor, the third resistor, and the second capacitor that are connected in parallel.

The method for driving an inverter for an LCD may further include: detecting a feedback signal from a lamp that provides a light source; and controlling the AC according to the feedback signal.

An example embodiment of the present invention will now be described in detail with reference to the accompanying drawings.

FIG. 1 is a view schematically showing the construction of a liquid crystal display (LCD) employing an inverter according to an embodiment of the current invention.

With reference to FIG. 1, the LCD according to the illustrated embodiment of the present invention includes a liquid crystal panel 100, a gate driver 110, a data driver 120, a timing controller 130, a gamma voltage generator 140, a backlight assembly 200, and an inverter 210.

The liquid crystal panel 100 includes a plurality of pixels (P) defined by gate lines GL1, GL2, . . . , GLn and data lines DL1, DL2, . . . , DLm that cross each other. Thin film transistors (TFTs), each having a gate electrode, an active layer, a source electrode, and a drain electrode, are disposed at respective crossings of the gate lines GL1, GL2, . . . , GLn and the data lines DL1, DL2, . . . , DLm.

A liquid crystal material is filled in each pixel (P) to form liquid crystal cells represented in FIG. 1 as equivalent circuits Clc, and a storage capacitor Cst is formed to uniformly maintain a pixel voltage applied to the liquid crystal cells Clc.

In the liquid crystal panel 100, an image is displayed by pixels (P) according to scan signals supplied through the gate lines GL1, GL2, . . . , GLn and analog pixel signals supplied through the data lines DL1, DL2, . . . , DLm. Here, the scan signal includes a pulse in which a gate high voltage supplied during a horizontal period for each gate line and a gate low voltage supplied to the gate line during the other horizontal periods of each image frame period.

When the gate high voltage is supplied to the gate lines GL1, GL2, . . . , GLn, the TFTs formed at respective pixels (P) supply the analog pixel signals provided from the data lines DL1, DL2, . . . , DLm to the liquid crystal cells Clc. When the gate low voltage is supplied to the gate lines GL1, GL2, . . . , GLn, the TFTs are turned off, so the analog pixel signals filled in the liquid crystal cells Clc can be maintained for a certain time period.

The gate driver 110 sequentially supplies scan signals to the gate lines GL1, GL2, . . . , GLn according to the gate control signals supplied from the timing controller 130.

In response to control signals supplied from the timing controller 130, the data driver 120 converts red, green, and blue pixel data inputted from the timing controller 130 into analog pixel signals and supplies the analog pixel signals to the data lines DL1, DL2, . . . , DLm.

The analog pixel signals have a gamma voltage selected according to red, green, and blue pixel data (gray level) inputted from the exterior among gamma voltages supplied from the gamma voltage generator 140.

The timing controller 130 receives the red, green, and blue pixel data from a source external to the liquid crystal display device, the re-processes red, green, and blue pixel data, and outputs the re-processed data to the data driver 120. In addition, the timing controller 130 generates a gate control signal for controlling a driving timing of the gate driver 110 and a data control signal for controlling a driving timing of the data driver 120 by using vertical and horizontal synchronous signals Vsync and Hsync, and a clock CLK.

The gate control signal includes a gate start pulse (GSP), a gate shift clock (GSC), a gate output enable (GOE) signal, and the data control signal includes a source start pulse (SSP), a source shift clock (SSC), a source output enable (SOE), a polarity (POL) signal.

The gamma voltage generator 140 generates gamma voltages required for digital/analog conversion of the data driver 120 by gray level within a gray scale range and supplies the gamma voltages to the data driver 120.

The backlight assembly 200 includes a plurality of lamps such as the cold cathode fluorescent lamps (CCFLs) or the exterior electrode fluorescent lamps (EEFLs), etc., and provides light toward the liquid crystal panel 100.

The inverter 210 converts DC power inputted from the exterior into AC power having a certain frequency and a voltage level suitable for the lamps of the backlight assembly 200 to drive the lamps.

In order to drive the CCFLs or the EEFLs used for the backlight assembly 200, the inverter 210 should be stably driven at a high frequency of 20 kHz to 200 kHz. According to the properties of the lamps, the inverter 210 supplies a high voltage required for turning on the lamps to the lamps at an initial stage of lighting, and after the lamps are turned on, the inverter 210 serves to maintain a uniform brightness of the lamps by controlling a tube current of the lamps.

The advantage of high driving the lamps using a high frequency supply is that the inverter 210 can be made small, the luminous efficacy of the lamps can be increased, and the life span of the lamps can be lengthened.

FIG. 2 is a view showing details of the construction of the inverter 210 shown in FIG. 1.

With reference to FIG. 2, the inverter 210 includes a DC/AC converting unit 220, a transformer 230, a frequency controller 240, a feedback circuit unit 250, etc.

The DC/AC converting unit 220 includes two or more switching elements that are alternately switched on or off and a constant current circuit that uniformly maintains the brightness of the lamps after the lamps are turned on, and converts DC power Vin inputted through an input terminal from an external voltage source into AC power and provides the AC power to a primary coil of the transformer 230.

The transformer 230 includes a primary coil connected to the DC/AC converting unit 220 and a secondary coil connected to the lamps via balancer capacitors Cb, and drives the lamps by converting an AC voltage supplied from the DC/AC converting unit 220 into a high voltage AC.

The transformer 230 steps up a voltage supplied to the primary coil according to a turn ratio of the primary coil and the secondary coil, and outputs the stepped up voltage from the secondary coil. The stepped up voltage output from the secondary coil is supplied to the lamps via electrodes formed at each of the two ends of the lamps to energize the lamps to emit light.

The balancer capacitors Cb are connected between an output terminal of the inverter 210 and each ends of the lamps. The balance capacitors maintain a balance of current to the lamps, and match impedance components of the output terminal of the inverter 210 to the impedances if lamps.

The frequency controller 240 is combined with the input terminal of the DC/AC converting unit 220 to control the DC/AC conversion so that upon initial driving, an output of the DC/AC converting unit 220 has an initial driving frequency during an initial driving time, and has a normal driving frequency larger than the initial driving frequency subsequent to the initial driving time.

The feedback circuit unit 250 may be used to detect a feedback signal from the lamps connected with the secondary coil of the transformer 230 and to supplies the feedback signal to the DC/AC converting unit 220 to allow the DC/AC converting unit 220 to maintain a uniform brightness for the lighted lamps. The feedback signal may represent the tube current flowing through either end of the lamps or may represent voltage applied across the ends of the lamps.

FIGS. 3A and 3B are views showing details of a frequency controller 240 shown in FIG. 2.

FIG. 3A is a view illustrating operation without the frequency controller 240. As shown, in the absence of the frequency controller 240, a resistor (R) and a capacitor (C) connected in parallel with a first input terminal (RT) and a second input terminal (CT) of the DC/AC converting unit 220 determine the driving frequency Fop of the DC/AC converting unit 220.

For the circuit illustrated in FIG. 3A, it may be assumed that the driving frequency Fop of an AC waveform output from the DC/AC converting unit 220, the resistor (R) and the capacitor (C) of the input terminal satisfy equation (1) shown below:

$$Fop = \frac{59 \times 10^4}{C_{CT} \times R_{RT}} \quad \text{[Equation 1]}$$

Here, the $C_{CT}$ is a capacitance value in picofarads [pF] of the capacitor (C), $R_{RT}$ is a resistance value in kilohms [kΩ], and Fop is the driving frequency measured in kilohertz [kHz], and 59×104 is a constant that is determined according to the details of the structure and integration type of the DC/AC converting unit 220.

For example, assuming that the driving frequency Fop of the AC waveform supplied from the DC/AC converting unit 220 satisfies equation (1), and that the resistor (R) is 41 kΩ, and the capacitor (C) is 220 pF, then the driving frequency Fop can be expressed by equation (2) shown below:

$$Fop = \frac{59 \times 10^4}{220 \times 41} = 65.4\,\text{kHz} \quad \text{[Equation 2]}$$

In this case, the DC/AC converting unit 220 continuously receives a fixed driving frequency Fop during the initial driving operation of the lamps and during the normal driving operation of the lamps following the initial driving operation.

When only the resistor (R) and the capacitor (C) are simply connected with the first input terminal RT and the second input terminal CT of the DC/AC converting unit 220 as shown in FIG. 3A, the DC/AC converting unit 220 outputs only an AC waveform of the normal driving frequency Fop.

When a single frequency is supplied by the DC/AC converting unit, the impedance deviation between the balancer capacitors Cb and the lamps formed at the rear stage of the DC/AC converting unit 220 cannot be reduced, inevitably causing the partial dimness phenomenon.

In addition, the balancer capacitors Cb should obtain a uniform capacitance value in order to compensate for impedance deviations in the equivalent capacitors of the lamps to thus maintain a uniform luminance during changes in the surroundings of the lamps such as temperature (high temperature or low temperature) or humidity changes.

In this respect, however, when the capacitance value of the balancer capacitors Cb is lowered, the compensation effect is reduced so that compensating the impedance change by changing the capacitance value of the balancer capacitors Cb limited.

FIG. 3B shows the construction of the frequency controller 240 that may address the problems described above. The frequency controller 240 is connected with the input terminal of the DC/AC converting unit 220 to determine the frequency of the AC waveform output from the DC/AC converting unit 220.

With reference to FIG. 3A, the frequency controller 240 includes a first resistor R1 having one end connected with a power source terminal Vcc, a first capacitor C1 formed between the other end of the first resistor R1 and a ground terminal, a transistor Q1 having a base connected to a node between the first resistor R1 and the first capacitor C1 and an emitter connected to ground, a second resistor R2 formed between the first input terminal RT of the DC/AC converting unit 220 and a ground terminal, and a third resistor R3 formed between a collector of the transistor Q1 and the second resistor R2 and connected with the second resistor R2 in parallel, etc. The transistor Q1 may be a bipolar junction transistor (BJT) or may be another switching device that controls voltage or current in an output circuit by varying a control current or voltage may be used.

The frequency controller 240 further includes a second capacitor C2 formed between the second input terminal CT of the DC/AC converting unit 220 and a ground terminal, and connected with the elements connected with the first input terminal RT in parallel.

During the initial driving operation, when a driving voltage is initially applied to the power source terminal Vcc, the transistor Q1 is turned off during for an initial driving time (τ) having a duration determined by the first resistor R1 and the first capacitor C1. The initial driving frequency output by the DC/AC converter Fig is determined by the second resistor R2 and the second capacitor C2.

During the normal driving operation that follows the initial driving time (τ), the transistor Q1 is turned on and the driving frequency Fop is determined by a parallel resistance value (R3||R2) of the third resistor R3 and the second resistor R2 and the capacitance value of the second capacitor C2.

This will be described in detail as follows.

During the initial driving operation, after a driving voltage (e.g., 5V) is applied to the power source terminal Vcc, the transistor Q1 is maintained in the OFF state during a certain time period (τ), namely, during the initial driving time (τ), determined by the time required to charge the first capacitor C1 through the first resistor R1 connected to the power source Vcc. Accordingly, the DC/AC converting unit 220 is driven using the initial frequency Fig. The initial frequency Fig is determined by the second resistor R2 connected with the first input terminal RT of the DC/AC converting unit 220 and the second capacitor C2 connected with the second input terminal CT of the DC/AC converting unit 220.

After the initial driving time (τ) in which the DC/AC converting unit 220 is driven by the initial frequency Fig, the voltage across the capacitor increases by charging through R1 sufficiently towards the driving voltage (e.g. 5V) to turn on the transistor Q1. Upon turning on the transistor Q1, the driving frequency Fop is determined by the parallel resistance value (R3||R2) of the second resistor R2 and the third resistor R3 and the capacitance value of the second capacitor C2, and the DC/AC converting unit 220 is driven using the determined driving frequency Fop.

For example, assuming that the resistance value of the second resistor R2 is 44 kΩ, the resistance value of the third resistor R3 is 600 kΩ, and the capacitance value of the second capacitor C2 is 220 pF, when equation (1) is applied to the input/output terminal of the DC/AC converting unit 220, the initial frequency (Fig) during the initial driving operation and the driving frequency Fop during the normal driving operation can be determined by equation (3) and equation (4) respectively as shown below:

$$Fig = \frac{59 \times 10^4}{220 \times 44} = 60.9\,\text{kHz} \quad \text{[Equation 3]}$$

$$Fop = \frac{59 \times 10^4}{220 \times 44 \| 600} = 65.4\,\text{kHz} \quad \text{[Equation 4]}$$

In this manner, by using the circuit including the resistor, the capacitor, and the transistor of the DC/AC converting unit 220 as the frequency controller 240 as shown in FIG. 3B, when the backlight assembly 200 is initially turned on, the driving frequency is lowered from normal operating value Fop to the initial frequency (Fig), and after a predetermined time period lapses the driving frequency is raised to the normal operating value Fop.

Without the frequency controller 240, the unbalance between the impedance component due to the equivalent capacitance of the lamps and the impedance of the balancer capacitors Cb may cause the partial dimness of the backlight assembly 200 during the initial driving of the backlight assembly 200.

Accordingly, during the initial driving period of operation of the lamps of the backlight assembly 200, the driving frequency Fop is shifted to the lower initial frequency Fig, for a certain time period (driving time) which results in an increase of the impedance of the balancer capacitors Cb.

In other words, in comparison with the case in which the backlight assembly 200 is driven continuously with driving frequency Fop, the supply of an initial frequency Fig to the backlight assembly during the initial period results in the impedance of the balancer capacitors Cb being increased to minimize the impedance deviation due to the equivalent capacitors of the lamps, and accordingly, the partial dimness phenomenon of the backlight assembly 200 can be reduced or eliminated.

Figure 4A:
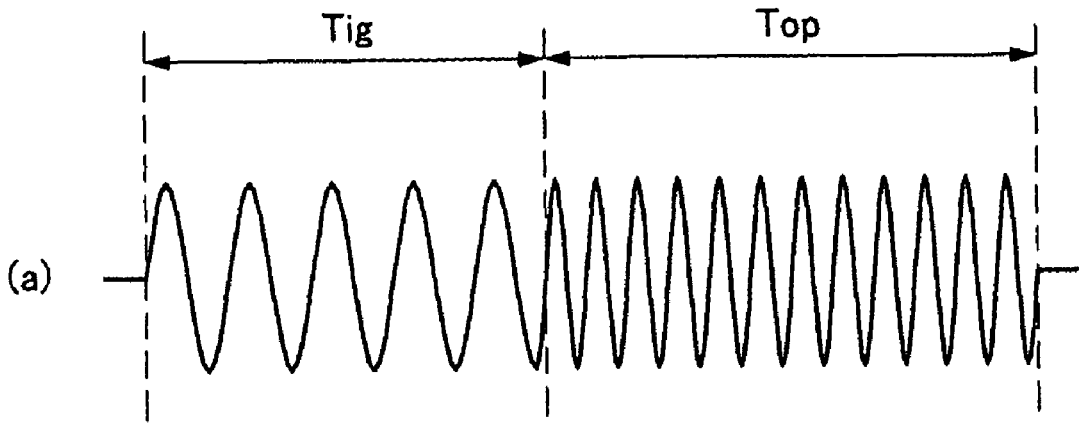
FIGS. 4A and 4B are views showing waveforms of a high voltage AC supplied to a lamp by the inverter in FIG. 1.
Figure 4B:
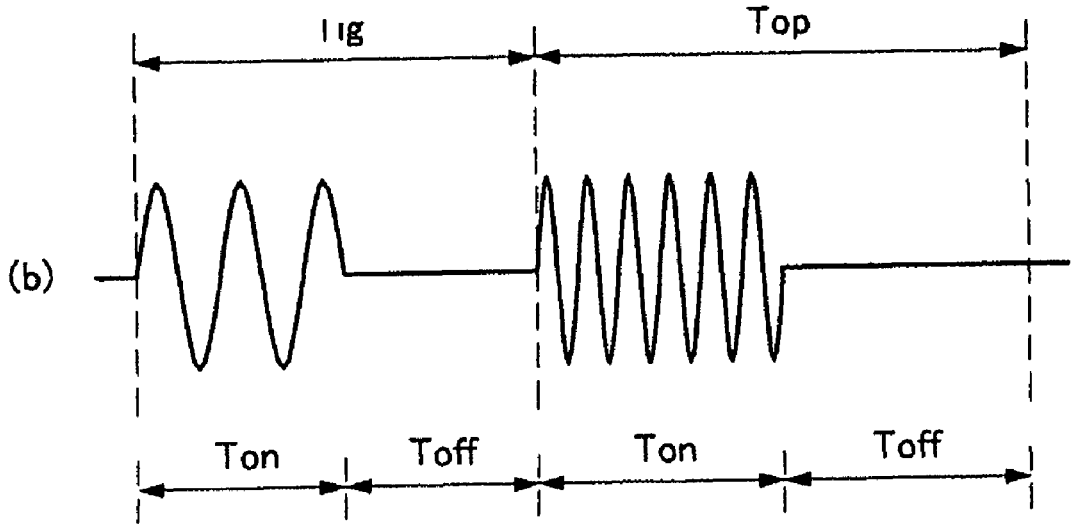

FIGS. 4A and 4B are views illustrating waveforms of a high voltage AC supplied to a lamp by the inverter in FIG. 1.

The frequency controller 240 controls the DC/AC converting unit 220 to output such an AC waveform as shown in FIG. 4A or FIG. 4B.

The DC/AC converting unit 220 outputs the AC waveform of the initial frequency Fig during the initial driving time Tig of the initial driving operation, and outputs the AC waveform of the driving frequency Fop higher than the initial frequency Fig, during the normal driving time Top that follows the initial driving time Tig.

The inverter 210 that includes the frequency controller 240 and the DC/AC converting unit 220 supplies a high voltage AC waveform to the lamps according to a driving method of the lamps.

The driving method of the lamps may be either a continuous mode driving method in which the high voltage AC waveform is continuously supplied as shown in FIG. 4A, or a burst mode driving method in which the high voltage waveform has certain periods as shown in FIG. 4B.

In the continuous mode driving method, a high voltage AC waveform is continuously supplied to the lamps as shown in FIG. 4A and the lamps are turned on continuously. On the other hand, in the burst mode driving method, the high voltage AC waveform has a duty cycle including an ON state (Ton) in which the high voltage is supplied and an OFF state (Toff) during which no high voltage is supplied to the lamps as shown in FIG. 4B. In the burst driving modes, the lamps are alternately turned on and off at during the corresponding Ton and Toff periods.

Figure 5:
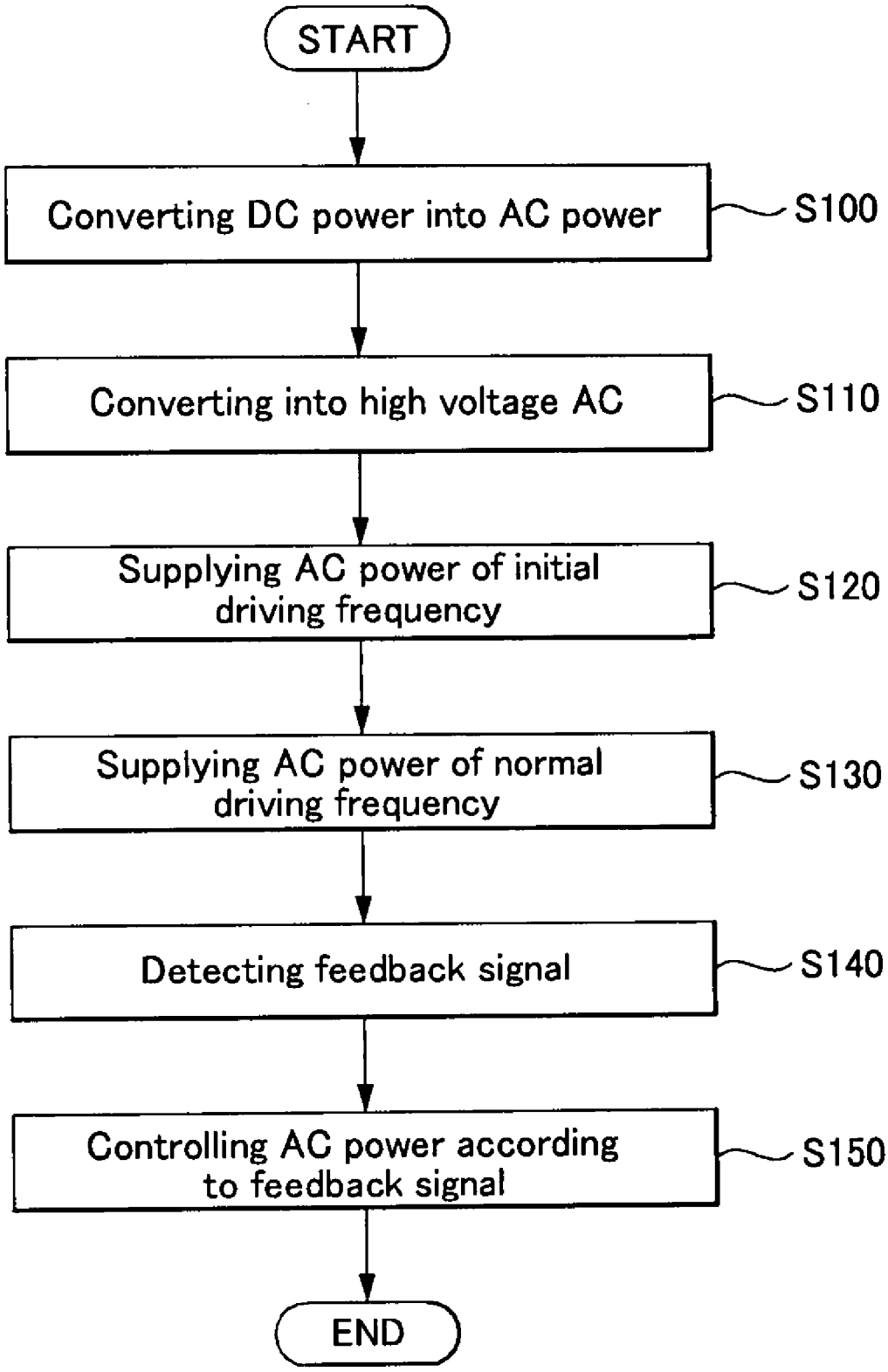
FIG. 5 is a flow chart illustrating a method for driving an inverter according to an embodiment of the present invention.

FIG. 5 is a flow chart illustrating a method for driving the inverter according to an embodiment of the present invention.

First, in step S100, the DC/AC converting unit 220 converts DC power supplied to its input terminal into AC power.

Next, in step S120, the transformer 230 converts the AC waveform into AC power of high voltage.

In step S120, the frequency controller 240 controls the converted high voltage AC power such that the AC waveform from the DC/AC converting unit 220 has the initial frequency during the initial driving time of the initial driving operation.

Thereafter, in step S130, the frequency controller 240 controls the converted high voltage AC power such that the AC waveform has the driving frequency larger than the initial frequency after the initial driving time.

The frequency controller 240, which performs the steps S120 and S130, may include the first resistor R1 having one end combined with the power source terminal Vcc, the first capacitor C1 formed between the other end of the first resistor R1 and the ground terminal, the transistor Q1 having the base connected with the node between the first resistor R1 and the first capacitor and the grounded emitter, the second resistor R2 formed between the first input terminal RT of the DC/AC converting unit 220 and the ground terminal, and the third resistor R3 formed between the collector of the transistor Q1 and the second resistor R2 and connected in parallel with the second resistor R2.

During the initial driving operation in step S120, after the frequency controller 240 applies the driving voltage to the power source terminal Vcc, the frequency controller 240 maintains the transistor Q1 in the turned-off state during the initial driving time determined by the first resistor R1 and the first capacitor C1.

During the initial driving time, the initial frequency is determined by the second resistor R2 and the second capacitor C2.

In step S130, during the normal driving operation that follows the initial driving time, the transistor Q1 is turned on and the driving frequency is determined by the third resistor R3, the second resistor R2, and the second capacitor C2 that are connected in parallel.

In steps S140 and S150, the feedback circuit unit 250 detects the feedback signal of the lamps connected with its output terminal and supplies the feedback signal to the DC/AC converting unit 220. The DC/AC converting unit 220 maintains the tube current of the lamps or the voltage applied across the ends of the lamps at a certain uniform value to thus obtain uniform brightness of the lamps.

As described above, the inverter for the LCD and its driving method according to embodiments of the present invention have such advantages that the impedance deviation between the output terminal and the lamps, the load of the output terminal, can be minimized by applying suitably lowered driving frequency during the initial driving operation.

Accordingly, the partial dimness phenomenon that may be caused by the impedance deviation between the output terminal and the load can be reduced or eliminated, and thus an improvement in display quality can be accomplished.

The foregoing embodiments and advantages are merely exemplary and are not to be construed as limiting the present invention. The present teaching can be readily applied to the other types of apparatuses. It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An inverter for a liquid crystal display comprising:

a DC/AC converting unit that converts DC power supplied from a voltage source into AC power;

a transformer that converts the AC power supplied from the DC/AC converting unit into a high voltage AC; and a frequency controller that is connected to the DC/AC converting unit to control the frequency of an output of the DC/AC converting unit such that the output of the DC/AC converting unit has an initial driving frequency during an initial driving time when initiating driving of a liquid crystal panel and such that the output of the DC/AC converting unit has a normal driving frequency larger than the initial driving frequency after the initial driving time, wherein the frequency controller includes:

a first resistor having one end connected with a power source voltage;

a first capacitor formed between the other end of the first resistor and a ground potential source:

a transistor having a base connected to a node between the first resistor and the first capacitor and an emitter connected the ground potential source;

a second resistor connected between a collector of the transistor and a first input terminal of the DC/AC converting unit; and a third resistor having one end connected with the first input terminal of the DC/AC converting unit and the other end connected with a ground potential source, wherein the transistor upon turning on connects the third resistor in parallel with the second resistor.

2. The inverter of claim 1, further comprising:

a second capacitor connected between a second input terminal of the DC/AC converting unit and a ground potential source.

3. The inverter of claim 2, wherein upon applying an initial driving voltage the transistor is maintained in a turned-off state during an initial driving time beginning upon application of the initial driving voltage, the duration of the initial driving time determined by the first resistor and the first capacitor, and wherein the initial driving frequency is determined by the third resistor and the second capacitor during the initial driving time.

4. The inverter of claim 2, wherein the transistor is turned on during a normal driving time that follows the initial driving time, and the normal driving frequency is determined by the second resistor, the third resistor, and the second capacitor.

5. The inverter of claim 1, wherein the transistor is a bipolar junction transistor (BJT).

6. The inverter of claim 1, wherein the inverter further comprises a feedback circuit unit that detects a feedback signal from a lamp connected to a secondary side of the transformer and supplies the feedback signal to the DC/AC converting unit.

7. The inverter of claim 6, wherein the feedback signal is a tube current supplied to the lamp.

8. A method for driving an inverter for a liquid crystal display, comprising:

converting DC power supplied to an input terminal into AC power;

converting the AC power into a high voltage AC and outputting the same;

controlling the converting DC power supplied to the input terminal into AC power such that the AC power has an initial driving frequency during an initial driving; and controlling the converting DC power supplied to the input terminal into AC power such that the AC power has a normal driving frequency larger than the initial driving frequency during a normal driving that follows the initial driving, wherein the controlling the converting DC power supplied to the input terminal into AC power such that the AC power has the initial driving frequency during the initial driving and the controlling the converting DC power supplied to the input terminal into AC power such that the AC power has the normal driving frequency larger than the initial driving frequency during the normal driving that follows the initial driving are performed by a frequency controller, wherein the frequency controller comprises:

a first resistor having one end connected with a power source voltage;

a first capacitor connected between the other end of the first resistor and a ground potential source;

a transistor having a base connected to a node between the first resistor and the first capacitor, and an emitter connected to a ground potential source;

a second resistor connected between a collector of the transistor and a first input terminal of a DC/AC converting unit; and a third resistor having one end connected with a first input terminal of the DC/AC converting unit and the other end connected with a ground potential source, so as to be connected in parallel with the second resistor upon turning on the transistor.

9. The method of claim 8, wherein, the controlling the converting DC power supplied to the input terminal into AC power such that the AC power has the initial driving frequency during the initial driving includes maintaining the transistor in a turned-off state during an initial driving time having a duration determined by the first resistor and the first capacitor, and determining the initial driving frequency using the third resistor and the second capacitor during the initial driving time.

10. The method of claim 8, wherein in controlling the converting DC power supplied to the input terminal into AC power such that the AC power has the normal driving frequency larger than the initial driving frequency during the normal driving that follows the initial driving, the transistor is turned on during the normal driving that follows the initial driving, and the normal driving frequency is determined by the second resistor, the third resistor, and the second capacitor that are connected in parallel.

11. The method of claim 8, further comprising:

detecting a feedback signal from a lamp that provides a light source; and controlling a voltage of the high voltage AC according to the feedback signal.

* * * * *